US006126498A

United States Patent [19]

Icenogle et al.

[11] Patent Number: 6,126,498

[45] Date of Patent: Oct. 3, 2000

[54] HYDRAULIC MARINE JACK PLATE POSITION INDICATOR

[76] Inventors: Robert O. Icenogle, 1501 33rd St. SE., Ruskin, Fla. 33670; Richard W. Quail, 3224 47th Ter., St. Petersburg, Fla. 33714

[21] Appl. No.: 09/329,375

[22] Filed: Jun. 10, 1999

[51] Int. Cl.[7] ..... B63H 20/08

[52] U.S. Cl. ..... 440/53; 440/61

[58] Field of Search ..... 33/DIG. 1; 440/53, 440/61, 900, 1, 2

[56] References Cited

U.S. PATENT DOCUMENTS

| | | | |
|---|---|---|---|
| 3,591,825 | 7/1971 | Keighley, Jr. . | |
| 4,482,330 | 11/1984 | Cook | 440/2 |
| 4,652,878 | 3/1987 | Borgersen | 340/984 |
| 5,749,696 | 5/1998 | Johnson | 414/635 |

*Primary Examiner*—Ed Swinehart
*Attorney, Agent, or Firm*—Donald R Bahr

[57] ABSTRACT

A position indicator for a hydraulic jack plate for use with a marine outboard motor in a marine environment, the position indicator allows a boat operator to determine the position of an outboard motor relative to some fixed reference point usually the upper edge of the transom of a boat, the hydraulic jack plate has a fixed support and a moveable slide, a magnet is attached to the fixed support, this magnet activates individual segments of a multi segment transducer which is secured to the moveable slide of the jack plate when activated each segment of multi segment transducer produces a specific voltage which in turn activates a particular L.E.D., by observing which L.E.D. is activated an operator can determine the position of the slide and hence the position of the outboard motor, the light output of the L.E.D.'s is varied in relation to the ambient light.

8 Claims, 3 Drawing Sheets

HYDRAULIC MARINE JACK PLATE POSITION INDICATOR

FIELD OF THE INVENTION

This invention is concerned with hydraulic marine jack plates which are commonly used in conjunction with outboard motors. Most larger outboard motors are supplied with integral hydraulic motors and related hydraulic cylinders wherein the outboard motor can be angularly disposed in relation to the transom of a boat to which it is attached. While this angular disposition of an outboard motor in relation to the transom of a boat is useful, in many situations it has been found that it is highly desirable to move an outboard motor vertically in a plane which is parallel with the transom of a boat. It is in this field that hydraulic jack plates of this invention is useful.

When a hydraulic jack plate is used to move an outboard motor vertically up the efficiency of the outboard motor can be greatly enhanced particularly in high speed operation. In many instances when an outboard motor and the boat to which it is attached is operating at high speeds the lower unit of the outboard motor creates excessive drag which impairs the operating efficiency of the outboard motor and the boat to which it is attached.

By the use of a hydraulic jack plate an outboard motor can be moved in a vertical plane in order that the outboard motor and boat combination can achieve optimum operating efficiency under all operating conditions.

Further by use of a hydraulic jack plate an outboard motor can be moved up in order to allow the outboard motor and boat combination to operate in shallow water. In many instances by using a hydraulic jack plate and moving the outboard motor up most boats can operate in water which is only a few inches deeper than the draft of the particular boat.

The subject invention is concerned with an improvement wherein the position of a marine hydraulic jack plate can be remotely determined.

This enhancement is achieved by providing apparatus whereby the position the slide of a hydraulic jack plate, and hence the position of the outboard motor which is attached thereto can be determined in relation to a fixed point usually the top of the transom of the boat.

Accordingly, it is an object of this invention to provide a hydraulic jack plate position indicator wherein the sensor and indicator are remote to each other.

It is a further object of this invention to provide a hydraulic jack plate sensor system which is light sensitive.

These objects and advantages should be construed as merely illustrative of some of the more prominent features and applications of the present invention. Accordingly, other objects and advantages, as well as a fuller understanding of the invention, may be had by referring to the summary and detailed description of the preferred embodiment of the invention in addition to the scope of the invention, as is defined by the specifications and claims taken in conjunction with the accompanying drawings.

SUMMARY OF THE INVENTION

The present invention is defined by the appended claims with the specific preferred embodiment shown in the attached drawings. For the purpose of summarizing the invention, the invention may be defined as a hydraulic jack plate position indicator wherein the position of a hydraulic jack plate is segmented and each segment incorporates with a particular light emitting dioide herein after referred to as L.E.D.

Hydraulic jack plates comprise four main components these being a hydraulic pump, a hydraulic cylinder, a support which is attached to the transom of a boat and a slide which moves in the support and to which the outboard motor is attached. This invention is concerned with apparatus whereby the position of the slide and hence the position of the outboard motor can be determined.

In order to achieve these ends the support is provided with an activator and the slide is provided with a segmented transducer. Each segment of the transducer produces a specific voltage which activates a particular voltage sensitive L.E.D. in a gauge assembly. The gauge assembly comprises a plurality of voltage sensitive L.E.D.'s. The hydraulic jack plate indicator system of this invention is further provided with a means whereby the intensity of the light emitted by the L.E.D 's can be regulated in relation to the ambient light in which the gauge assembly is located.

The foregoing has outlined rather broadly the more pertinent and important features of the present invention in order that the detailed description of the invention that follows may be better understood. Additional features of the invention will be described hereinafter which form the subject of the claims of the present invention. It is appreciated by one skilled in the art, that the conception and the specific embodiment disclosed herein may be readily utilized as a basis for modifying or designing other apparatus or processes for carrying out the purposes of the present invention. It is also realized by one skilled in the art that such equivalent apparatus and process do not depart from the spirit and scope of the invention as set forth in the appended claims.

DESCRIPTIONS OF THE DRAWINGS

FIG. 1 a side view showing the general relationship of a hydraulic jack plate, a boat and an outboard motor which are the subject matter of this invention.

DESCRIPTION OF THE PREFERRED EMBODIMENT

Figure 3:
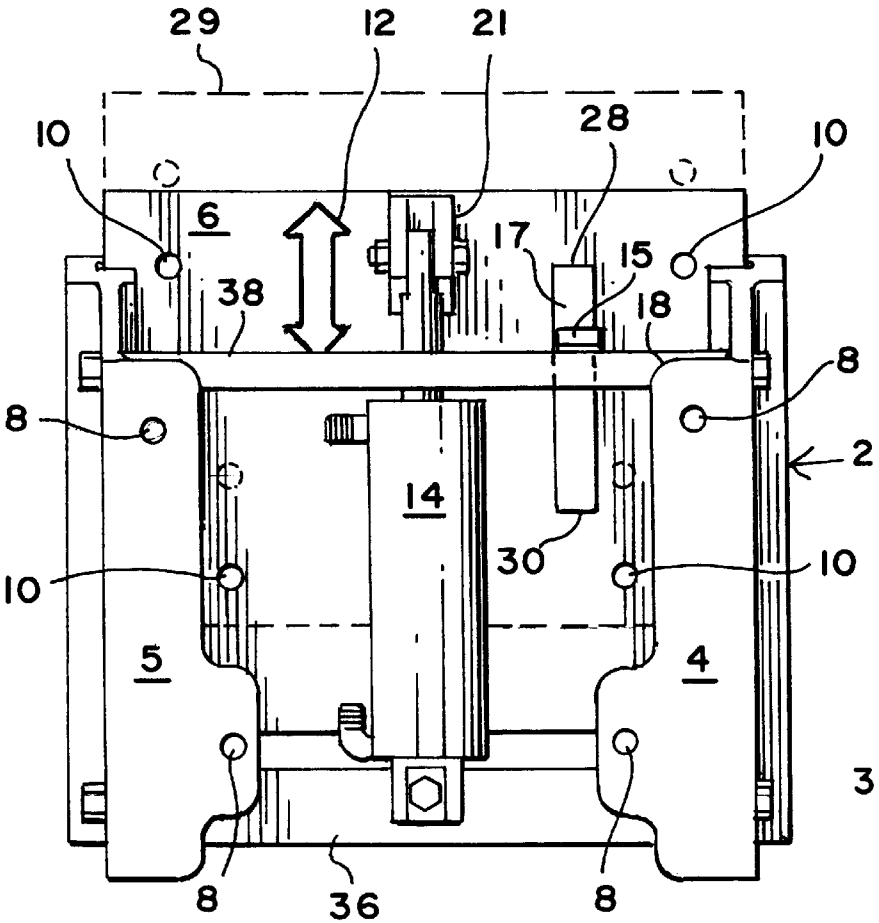
FIG. 3 is a rear view showing a hydraulic jack plate with the position indicator of this invention attached thereto.

As is generally discussed above the subject invention relates to a position indicator for use with a marine hydraulic jack plate as is shown in FIG. 3, the movement of slide 6 of jack plate 2 is illustrated by phantom line 29.

Figure 1:
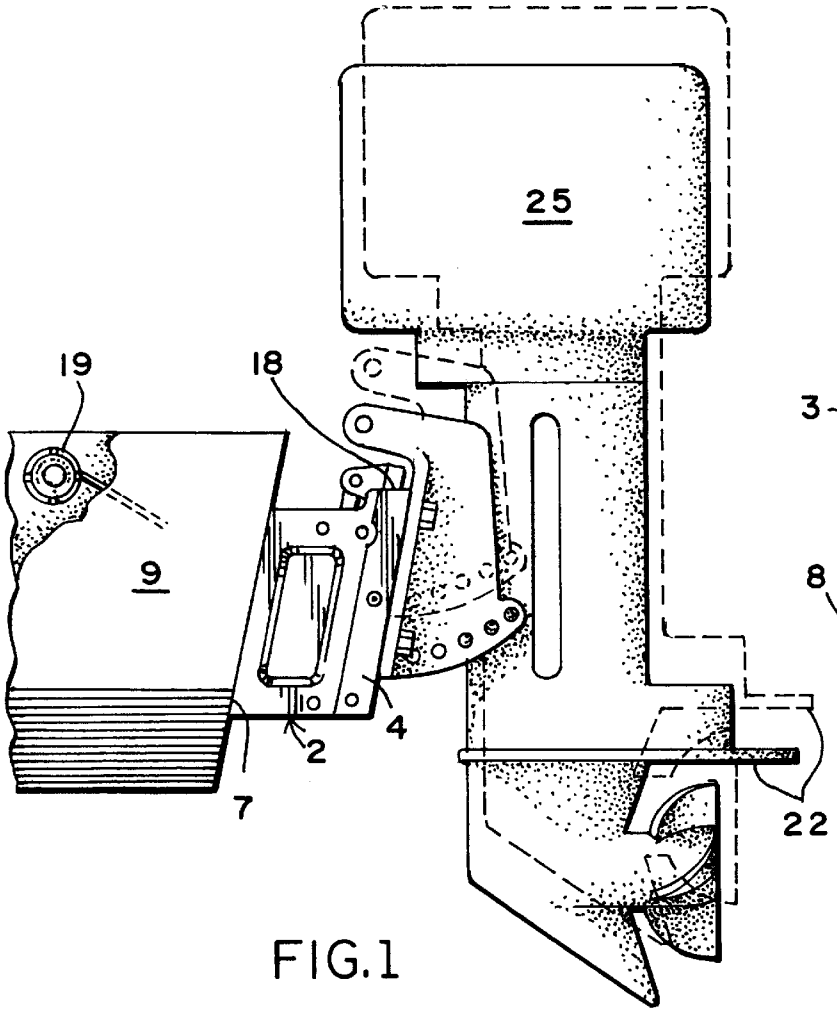
Figure 4:
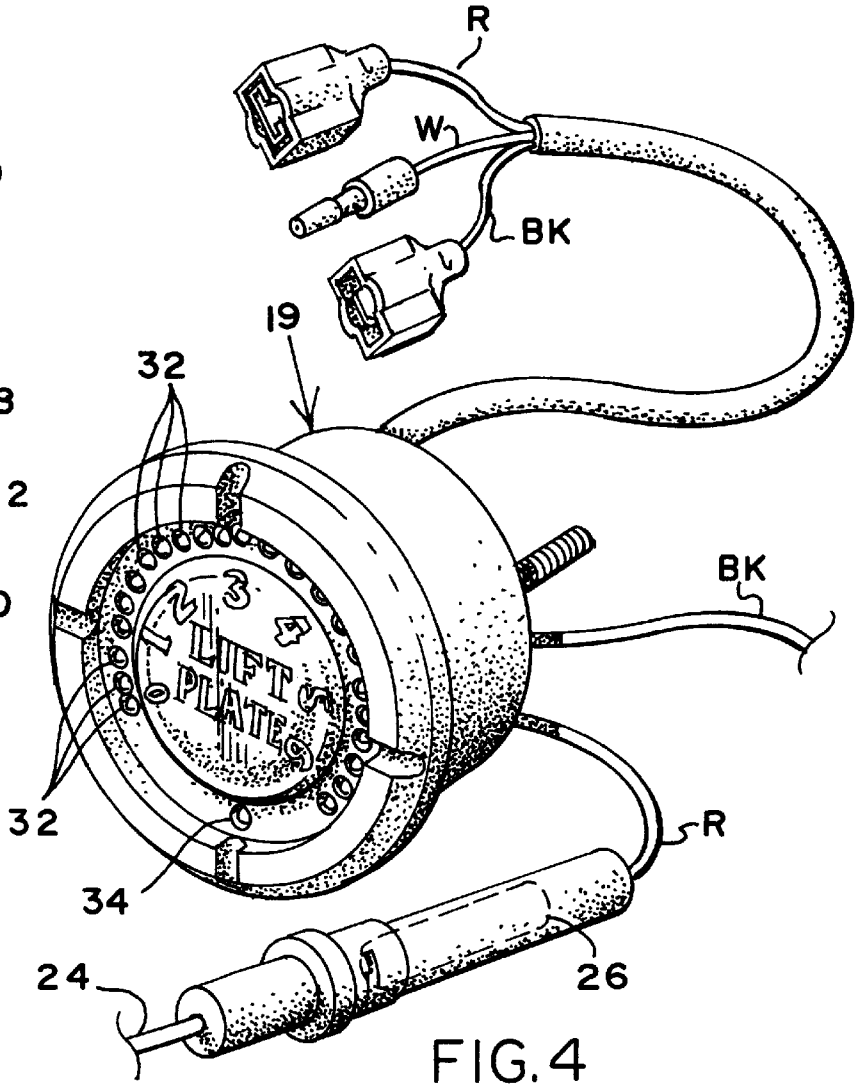
FIG. 4 is a perspective view showing the gauge assembly of this invention.

Referring to FIGS. 1 and 3 it can be seen that hydraulic jack plate 2 of this invention incorporates a plurality of components. These components generally comprise a pair of opposing supports 4 and 5 which are attached to the transom 7 of a boat 9 shown in partial section, supports 4 and 5 are interconnected by a plurality of lateral connectors 36,38 40 and 42. The attachment of jack plate 2 to boat 9 is effected by bolts (not shown) which are passed through aperture 5, 8 and through the boat transom 7 in a conventional manner.

Figure 2:
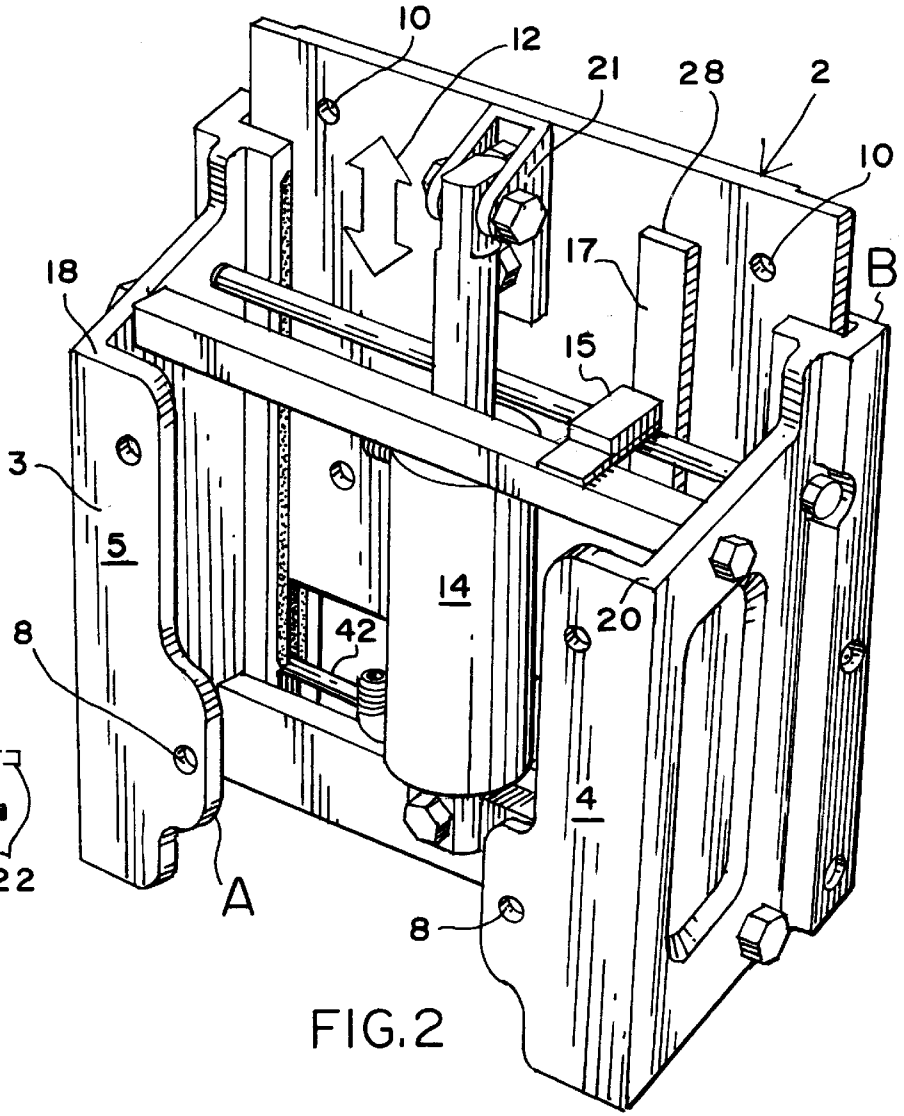
FIG. 2 is a perspective view showing a hydraulic jack plate with the position indicator of the invention attached thereto.

In the broadest embodiment the hydraulic jack plate 2 of this invention comprises a support 3 which in the illustrated structure of FIG. 2 comprises support members 4 and 5, a plurality of support bars and a slide 6 which can move up and down in a vertical plane. Support 3 has a first planar surface A which is adapted to being secured to the transom of a boat and a second planar surface B which is adapted to slideably engage slide 6.

When positioned in supports 4 and 5 in the manner described slide 6 can move up and down in a vertical plane in the directions of arrow 12. This invention is concerned with the position of slide 6 to a given reference point for example inner upper edges 18 and 20 of support 3. In order that the position of slide 6 might be determined support 3 is provided with a magnet 15 and a segmented transducer 17 which is attached to slide 6. Magnet 15 is used to activate the individual segments of transducer 17.

Slide 6 and support 3 are further interconnected by a hydraulic cylinder 14 which is attached to support 3, the piston thereof being attached to slide 6 via shaft 13 and bracket 21.

Hydraulic cylinder 14 is powered by hydraulic fluid which is provided for by a hydraulic pump (not shown). The hydraulic fluid being transferred from the hydraulic pump to hydraulic cylinder 14 via hydraulic lines (not shown) which interconnect the hydraulic pump and hydraulic cylinder 14, outboard motor 25 is attached to slide 6 via apertures 10. Hydraulic jack plates of the type described above and which are powered by a hydraulic cylinder and a hydraulic pump as described above are conventional in the prior art.

As can be further seen from FIG. 2 the full length of segmented transducer 17 passes by magnet 15 as slide 6 moves up and down in the directions of arrow 12. The movement of slide 6 is effected by hydraulic cylinder 14 in accordance with the description herein above.

In operation as slide 6 moves up and down different sections of segmented transducer 17 pass by magnet 15 via the Hall effect magnet 15 causes the individual segments of transducer 17 to produce a particular voltage as will be described herein below. When a given section of segmented transducer 17 passes by magnet 15 it is activated by magnet 15. The activation of this given section causes the section to produce a predetermined voltage output. The particular voltage output of any given section activates a particular L.E.D. in gauge 19 via a circuit which will be discussed below. Segmented transducer 17 has a top 28 and a bottom 30. The area between top 28 and bottom 30 is segmented into a plurality of sections. Each section produces a particular voltage which activates a particular L.E.D. in gauge 19. It is understood that the number of sections into which transducer 17 is divided is a matter of choice. The more sections transducer 17 is divided into the more accurate the position of slide 6 can be determined.

In conventional jack plates the total travel of slide 6 from its lowest to its highest position is about seven inches. With this amount of travel it has been found that the ability to determine the position of slide 6 over approximately a six inch span is adequate for normal hydraulic jack plate operation, that is the determination of the movement of slide 6 over a 0 to 6 inch range is adequate for normal hydraulic jack plate operation.

With this range of operation in mind it has been found to be desirable to divide transducer 17 into 25 sections which in turn correspond to each ¼ inch movement of slide 6.

Gauge 19 is in turn provided with 25 L.E.D.'s each of which can be activated by a L.E.D. driver integrated circuits. Therefore in operation as slide 6 moves up and down at any given position magnet 15 activates one section of transducer 17. This activated section of transducer 17 produces a specific voltage which in turn lights up a particular LED. That is as slide 6 moves up, for every ¼ inch the slide moves a different LED is activated. As can be seen gauge 19 incorporates twenty five L.E.D.'s in a circular pattern. A boat operator can readily determine the position of slide 6 by observing which L.E.D. in gauge 19 is lit up. By knowing the position of slide 6 the operator in turn knows how far outboard motor 25 is in the water as is the best indicated by the position of cavation plate 22 of outboard motor 25.

Figure 5:
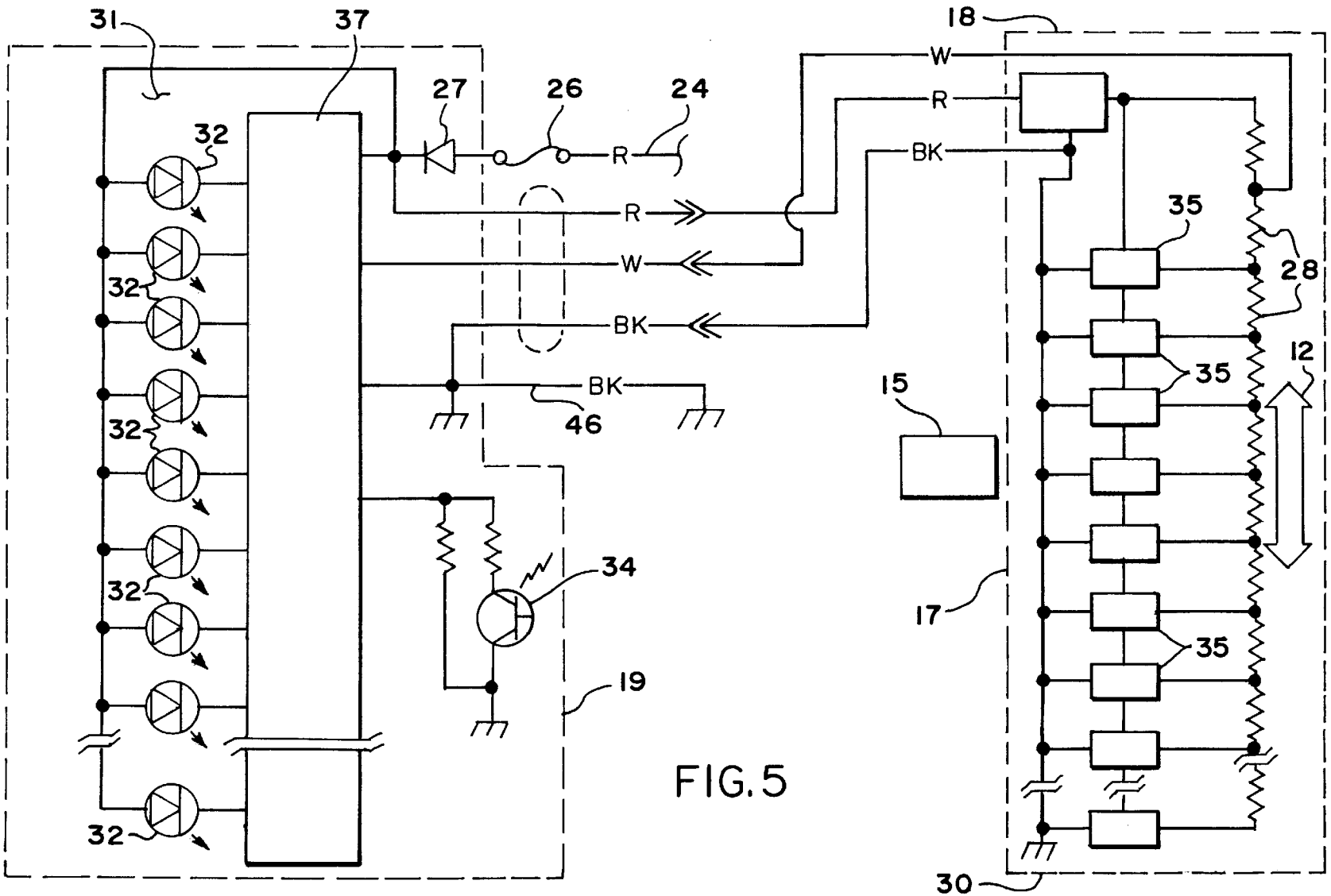
FIG. 5 is a circuit diagram of the position indicator of this invention.

Referring to FIG. 5 it can be seen that the electrical circuit for use with the position indicator of this invention comprises a power source 24 which is connected via fuse 26 to a voltage resistance ladder divider 28. Intermediate of power 24 and ladder divider 28 is a protective diode 27 which protects the circuit from reverse bias current/voltage in the event the power is hooked up in reverse. Ladder divider 28 is further connected to an L.E.D. circuit 31 which incorporates a plurality of L.E.D.'s 32 which are positioned in gauge 19. In the preferred embodiment twenty five L.E.D's are used wherein the movement of slide in ¼ inch increments correspond to each L.E.D. 32.

The voltage produced by the individual segments of ladder divider 28 is picked up by a plurality of sensors 35 which sense small variations in the voltage output of ladder divider 28. Sensor 35 then transmit data relative to the voltage output of ladder divider 28 to L.E.D. driver integrated circuit 37.

Upon receipt of information from Sensors 35 L.E.D. integrated circuit 37 processes the data relative to the particular voltage output of a particular segment of ladder divider 28 and determines which of L.E.D.'s 32 should be activated. That is when a particular segment of ladder divider 28 produces a particular voltage this particular voltage is sensed by one of sensors 35, This voltage output information is then transmitted to L.E.D. driver integrated circuit 37 which processes the information and determines whether one of LED.'s 32 should be lit. Via this circuit the lighting up of a particular one of L.E.D. 32 correlates to a particular position of transducer 17 and hence a particular position of slide 6.

If desired a plurality of L.E.D. integrated circuits 37 may be used that is circuits 37 may be stacked. In the preferred embodiment three L.E.D. integrated circuits are stacked.

The voltage output of ladder divider 28 may vary over the range of 1 to 12 volts. In the preferred embodiment the range of voltage output of ladder divider 28 is 1 to 4.5 volts.

It is understood by one skilled in the art that any number of L.E.D.'s can be used to correspond to the movement of slide 6 through any desired range of travel.

Light sensor circuit 34 is further provided for whereby the voltage going to L.E.D.'s 32 can be varied in order to vary the intensity of the output of LED's 32 in order to make the light output L.E.D.'s 32 greatest in bright sunlight. Conversely when the ambient light decreases it is desirable to have the light output of L.E.D.'s 32 decrease.

Further one skilled in the art will recognize that the relationship of magnet 15 and transducer 17 could be reversed such that the transducer is stationary and the activator magnet moves.

The above description and drawings are illustrative of modifications that can be made without departing from the present invention, the scope of which is to be limited only by the following claims.

What is claimed is:

1. An improved hydraulic marine jack plate, comprising a support and a slide for use with an outboard engine, which will allow vertical movement of the outboard marine engine in a plane which is parallel with the transom of a boat when said jack plate is attached to said transom, said support being adapted to receive said slide member such that said slide member can move up and down in a plane which is approximately parallel with the transom, wherein said support member and said slide are interconnected by a hydraulic cylinder which is in turn connected to a source of hydraulic power, wherein the improvement comprises; a position indicator, for tracking the position of the slide in relation to the support, comprising an activator which is attached to either the slide or the support and an electronic signal generating device which is capable of being activated, wherein said electronic device is positioned near said activator and wherein the signal output of the electronic device is regulated, in relation to ambient light, by a photoelectric cell.

2. The improved marine hydraulic jack plate of claim 1 wherein the signal generated is transmitted to a remote gauge which is capable of indicating the position of the slide in relation to the support.

3. The improved marine hydraulic jack plate of claim 1 wherein the remote gauge incorporates one or more light emitting diodes which are capable of reacting with the signal generated by the electronic device.

4. The improved marine hydraulic jack plate of claim 3 wherein the electronic device is a transducer and the activator is a magnet.

5. The improved marine hydraulic jack plate of claim 4 wherein the gauge incorporates a plurality of light emitting diodes and the transducer is segmented, wherein each segment of the transducer is programmed to inter-react with a particular light emitting diode.

6. The improved marine hydraulic jack plate of claim 5 wherein each segment of the transducer is programmed to produce a particular voltage, said particular voltage being sensed by an integrated circuit which controls which light emitting will be activated.

7. The improved marine hydraulic jack plate of claim 6 wherein the transducer is segmented into twenty five sections.

8. The improved marine hydraulic jack plate of claim 7 wherein the slide is capable of approximately seven inches of vertical movement and each segment of the transducer corresponds to approximately 0.25 inches of movement in the slide.

* * * * *